United States Patent [19]

Bachschmid et al.

[11] Patent Number: 4,785,719

[45] Date of Patent: Nov. 22, 1988

[54] DIAPHRAGM FOR HIGH PRESSURE PUMPS, COMPRESSORS OR THE LIKE

[75] Inventors: Fritz Bachschmid, Friedrichshafen; Wilfried Goes, Immenstaad, both of Fed. Rep. of Germany

[73] Assignee: J. Wagner GmbH, Fed. Rep. of Germany

[21] Appl. No.: 544,884

[22] Filed: Oct. 24, 1983

Related U.S. Application Data

[63] Continuation of Ser. No. 264,812, May 18, 1981, abandoned.

[30] Foreign Application Priority Data

May 16, 1980 [DE] Fed. Rep. of Germany ..... 3018687

[51] Int. Cl.[4] ..... F04B 9/08

[52] U.S. Cl. ..... 92/95; 92/99

[58] Field of Search ..... 92/95, 98 R, 99; 417/383, 395, 562

[56] References Cited

U.S. PATENT DOCUMENTS

| | | | |
|---|---|---|---|
| 234,551 | 11/1880 | Edson | 417/562 |
| 2,202,313 | 5/1940 | Grove | 92/82 |
| 2,638,127 | 5/1953 | Griswald | 92/98 R |
| 2,904,068 | 9/1959 | St. Clair | 92/99 |
| 3,416,461 | 12/1968 | McFarland | 92/98 R |
| 3,680,981 | 8/1972 | Wagner | 417/395 |
| 3,972,654 | 8/1976 | Clayton et al. | 92/99 |
| 4,220,836 | 9/1980 | Hersey | 92/103 M |
| 4,284,260 | 8/1981 | Baranoff | 92/98 R |
| 4,292,887 | 10/1981 | Ohta et al. | 92/98 D |

FOREIGN PATENT DOCUMENTS

| | | | |
|---|---|---|---|
| 2526925 | 9/1976 | Fed. Rep. of Germany | 417/383 |
| 546307 | 7/1956 | Italy | 92/98 R |

*Primary Examiner*—Robert E. Garrett

[57] ABSTRACT

Diaphragms for pumps, compressors and the like are provided with a substantially flat planar end face confronting the media being pumped or compressed and have an outer peripheral zone for clamping the circumference of the diaphragm in the pump or compressor housing, an annular intermediate flexing or bending zone adjacent the clamping area, and a central thickened work zone with the flexible bending zone increasing in thickness toward the central working zone. The bending or flexing of the annular intermediate zone is limited to one side of the flat planar end face and the bending stresses are minimized.

7 Claims, 4 Drawing Sheets

DIAPHRAGM FOR HIGH PRESSURE PUMPS, COMPRESSORS OR THE LIKE

This is a continuation of application Ser. No. 264,812, filed 5/18/81, now abandoned.

BACKGROUND OF THE INVENTION

1. Field of the Invention

This invention relates to the art of diaphragms for pumps and the like in which the flexing stresses are controlled to provide long wear life and withstand high pressures. Specifically, the invention deals with a one-piece molded plastics material membrane or diaphragm disks for pumps, compressors and the like which has a flat planar end face confronting the media being pumped or compressed, an outer peripheral clamping area, an intermediate annular flexible bending zone adjacent the clamping area, and a central thickened rigid work zone with the annular flexible bending zone increasing in thickness between the clamping area and zone.

2. Prior Art

Pump diaphragms having thickened central work portions projecting from both of sides of a flexible zone to provide stability have been successfully employed particularly in pumps for abrasive fluids in order to separate the pump piston from these fluids. A hydraulic drive system including a liquid column under pressure moved by a piston serves to flex the diaphragm which is clamped around its periphery and which is mounted to move from a back seating position into a front seating position in housing recesses that cause the diaphragm to oscillate through its free flat condition into stretched positions on both sides of the clamped periphery. The hydraulic drive system has also been replaced with a mechanical tappet type drive or direct piston drive.

Such membranes or diaphragms are exposed to great stresses and have a short useful life since even after a short time damage occurs in the intermediate bending zone which is subject to an alternate load due to the oscillation on both sides of the flat neutral free stage. The short useful life of such diaphragms presents a troublesome service problem requiring replacement of the diaphragm or pump.

The same short wear life problem exists with diaphragms which are designed flat and are not even exposed to high stresses. For example, in German Pat. No. 2,742,139 a diaphragm guidance zone is provided in the pump adjacent the clamping zone so that pressure and flexing stresses do not occur at the same location. These constructions require additional structural space to provide the outer and inner guidance zone so that the components accepting this type of diaphragm must be relatively large in diameter.

While it is possible to dimension the bending zone of a diaphragm in such a manner as to resist stresses, excess material is required and the bending behaviour of the diaphragm is such that the pump capacity is very poor.

It would be an improvement in the art to provide a diaphragm for high pressure pumps, compressors and the like which exhibits a significantly higher useful life than previously available diaphragm and minimizes flexible or stretching without decreasing pumping volume.

SUMMARY OF THE INVENTION

This invention now provides a pump or compressor diaphragm having a substantially planar surface in the area of the work space facing the media to be pumped or compressed and having a thickened portion only on that opposite end face of the diaphragm facing the driving agent with a bending zone which increases in thickness toward the central thickened work zone.

To provide the desired angle of inclination $\beta$ of the bending zone a section of the diaphragm at its transition into the thickened central portion should be approximately 1.1 through 5 times the thickness of the section at the transition of the bending zone into the clamping area. The ratio of the thicknesses of the bending zone at the transition into the thickened zone and from the transition into the clamping area can be obtained according to the following equation where, as shown in FIGS. 5 and 6, $d_1$ is the diameter of the bending zone at the transition into the thickened zone; $d_2$ is the diameter of the bending zone at the transition into the clamping area; $h_1$ is the thickness of the bending zone at the thickened central zone; $h_2$ is the thickness of the bending zone at the clamping area; $\alpha$ (FIG. 4) is an angular section receiving the maximum load and k represents a factor in the magnitude of 1.1 through 5:

$$\frac{d_1 \cdot \pi \cdot \alpha}{360 \cdot 6} \cdot h_1^2 = k \cdot \frac{d_2 \cdot \pi \cdot \alpha}{360 \cdot 6} \cdot h_2^2$$

This equation when simplified by cancellation of identical factors on both sides of the equation becomes: $d_1 \cdot h_1^2 = k \cdot d_2 \cdot h_2^{2''}$.

The material thickness of the diaphragm at its transition into the clamping zone should be approximately 0.5 through 2 mm.

Giving an assumed diameter $d_2$ of the bending zone at its transition into the clamping area, as well as a prescribed displacement volume, the diameter can be selected from a curve (FIG. 7) derived from the trigonometric function of the tangent of the excursion angle $\gamma$ to the assumed diameter. Expediently, said diameter is placed in the transitional area of the curve between the flat and the steep rise. Thereby the excursion angle of the bending zone can be determined according to the following equation where s is the stroke of the diaphragm.

$$\tan\gamma = \frac{s \cdot 2}{d_2 - d_1 \text{ variable}}$$

In order to return the diaphragm into its respective initial position by means of the force of a spring, it is further advantageous to provide a diaphragm shank at the thickening which extends perpendicularly to the diaphragm and at which, thus, a pressure spring can be supported.

Further, in order to promote the discharge of the agent to be conveyed, the diaphragm can be provided with radially directed incisions in the form of grooves at its end face facing said agent to be conveyed, whereby it is appropriate that said grooves extend approximately to a diameter corresponding to the thickening.

Further, a concentric recess preferably adapted in shape to the intake valve can be provided in the end face of the diaphragm which faces the agent to be conveyed, the outer diameter of said recess to be dimensioned in such manner that the recess is covered by the thickening.

It is further applicable to design the thickening trapezoidal in cross-section and to work radially directed incisions in the form of grooves into said thickening on its end face facing the drive agent and/or on the conical generated surface for the purpose of an improved discharge of the drive working substance.

If a diaphragm is shaped according to the invention in that said diaphragm is designed as a nearly planar surface on its end face facing the agent to be conveyed, the thickening, in contrast thereto, is formed-on at one side of the other end face, and the bending zone exhibits a cross-sectional surface steadily increasing toward the thickening, or whereby only the cross-sectional surface of the bending zone steadily increases toward the thickening, it is possible to extend the useful life of the diaphragm to a significant degree in comparison to previously employed embodiments. Such a diaphragm is mounted so that it does not oscillate on both sides of its periphery but is limited to oscillation substantially toward and away from that side facing the drive agent, this side can be dimensioned in accord with the given loads independently of or in conjunction with the planar surface. Further, no excess material need be displaced. Accordingly, no substantial flexing beyond a flat free state occurs and the bending zone is thus only minimally stretched in one direction to have a long useful life.

Since only one-sided flexible of the diaphragm occurs no dead spaces decreasing pumping efficiency are formed. On the contrary, the diaphragm can lie completely flush against its allocated housing part, so that air inclusions in the conveying material are excluded. Thus, it is not only the useful life of a pump equipped with such a diaphragm which is increased but, rather, its conveying power is also significantly improved.

Further details of the diaphragm designed according to the invention can be derived from the sample embodiment shown in the drawing in which.

Figure 1:
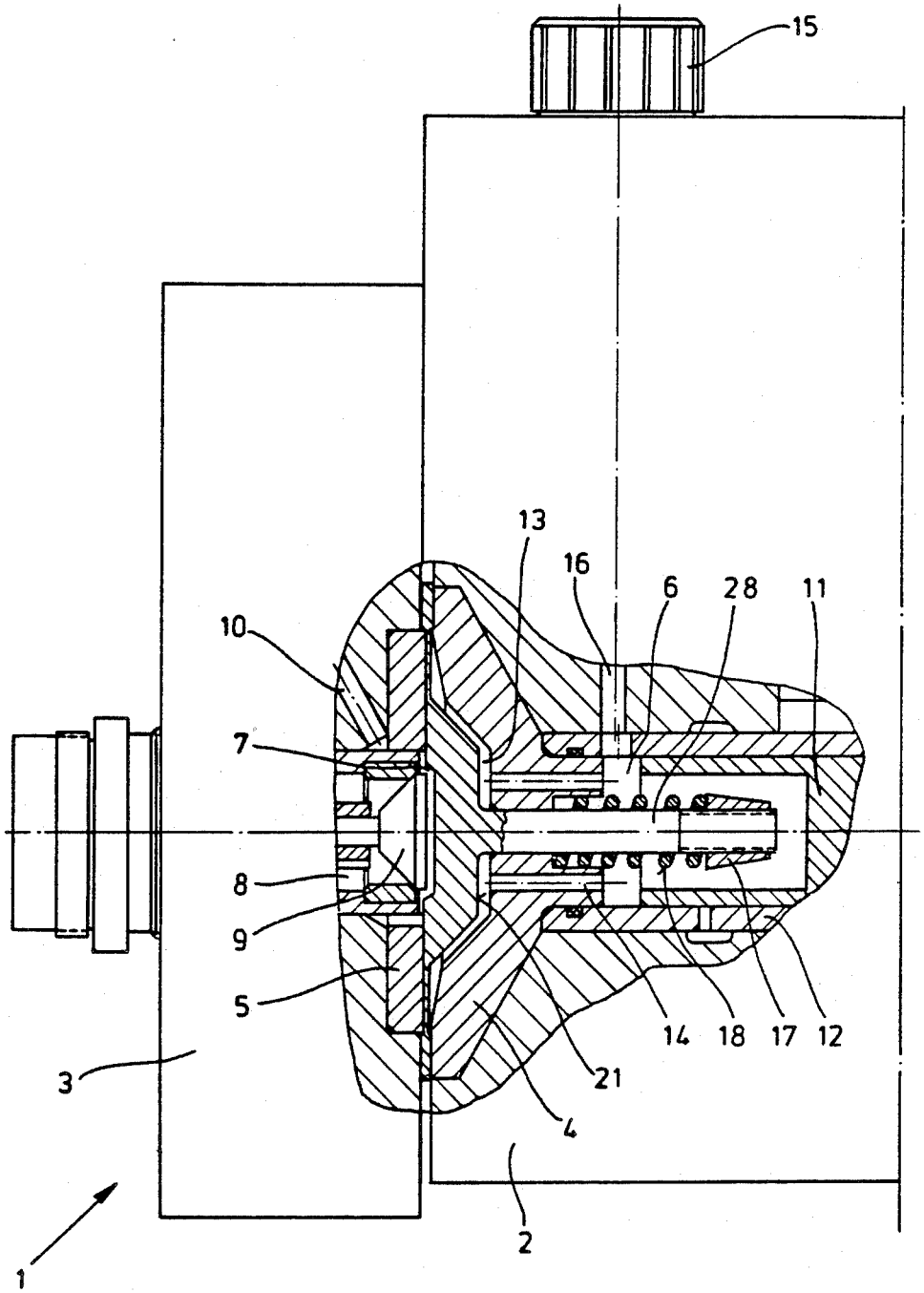
FIG. 1 shows a high pressure pump equipped with a diaphragm of this invention shown partially in section.
Figure 2:
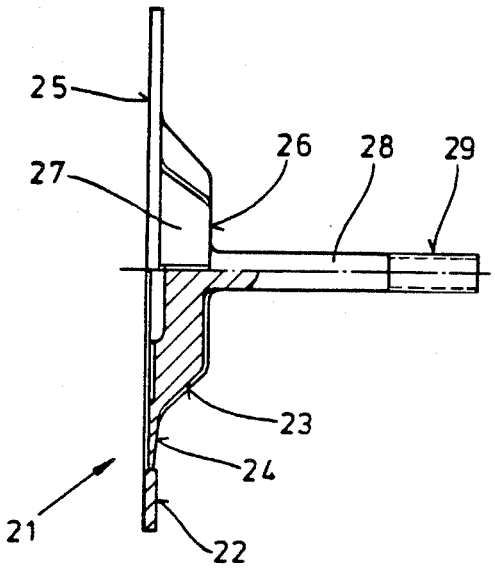
FIG. 2 shows the diaphragm of FIG. 1, as an individual part, partially in elevation and in a section, in its idle or free state.
Figure 3:
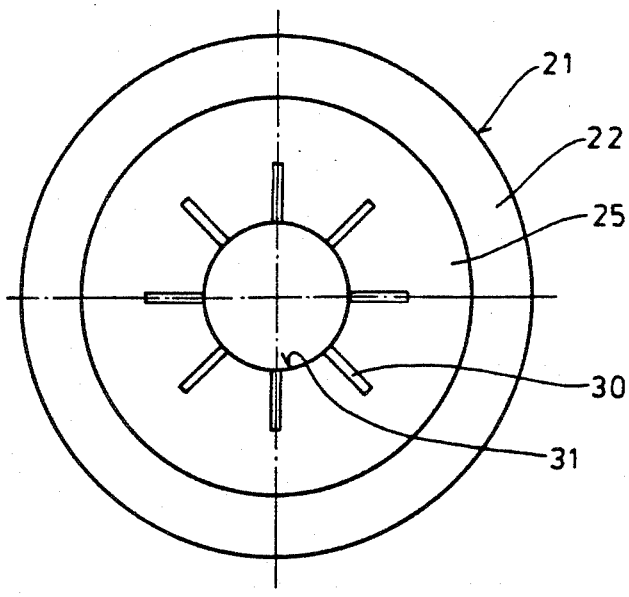
FIG. 3 shows the diaphragm of FIG. 2 in a view from below.
Figure 4:
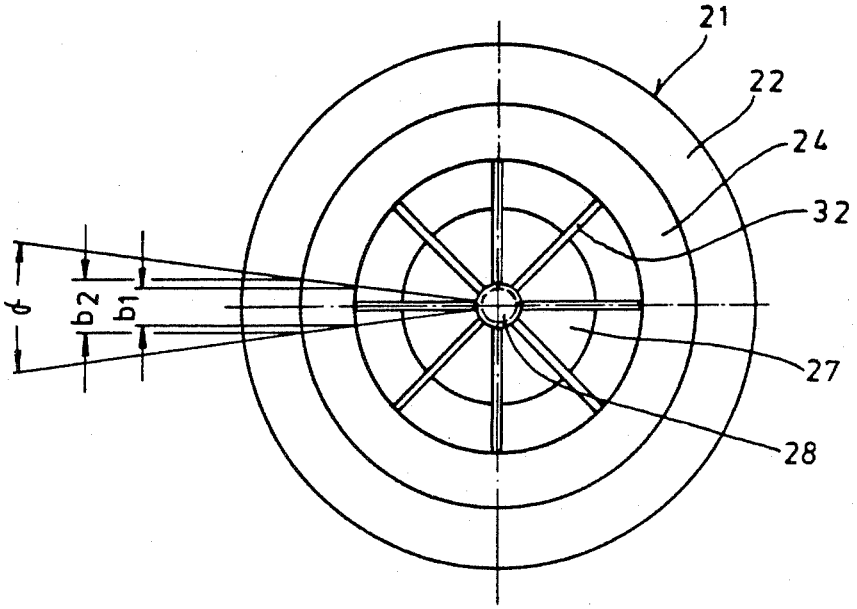
FIG. 4 shows the diaphragm of FIG. 2 in top plan.
Figure 5:
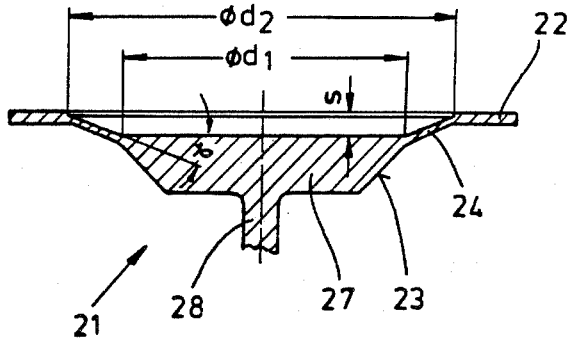
FIG. 5 shows the diaphragm of FIG. 2 in section in its flexed state.
Figure 6:
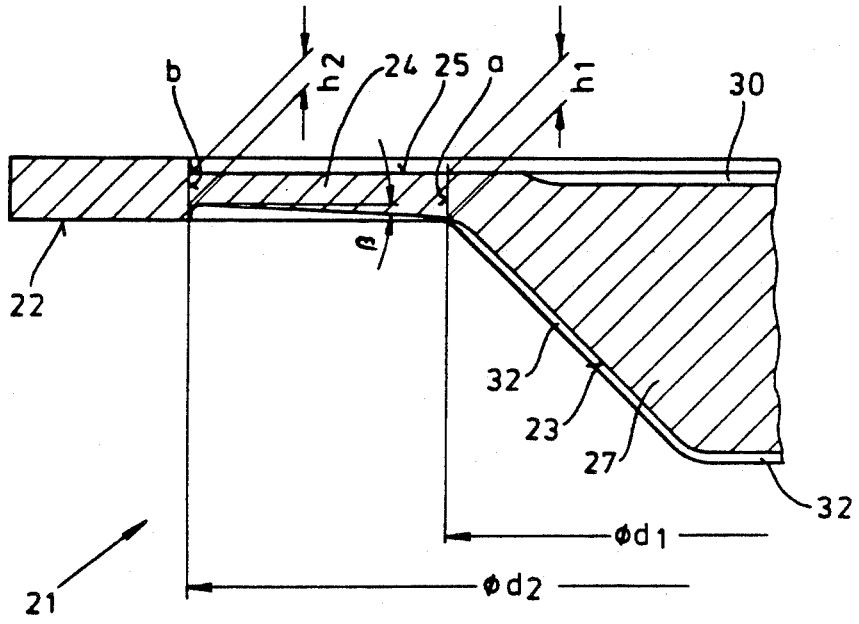
FIG. 6 shows an enlarged partial section of the flowing zone of the diaphragm.

The diaphragm pump 1 according to FIG. 1 essentially consists of a driven diaphragm disk 21 clamped between two housing parts 2 and 3 provided with seating disks 4 and 5, a pressure space 6 being separated from a work space 7 by means of said diaphragm. A piston 11 displaceably introduced into a cylinder 12 thereby serves for the drive of the diaphragm 21, said piston 11 being driven by a drive means (not illustrated), for example, an eccentric. The piston 11 influences the diaphragm 21 via a liquid column which is situated in the pressure space 6. To this end, the disk 4 is provided with bores 14 through which, the space 13 between the diaphragm 21 and the disk 4 is connected to the pressure space 6. Pressure peaks can be relieved by means of a pressure control valve 15 which is connected via a line 16 to the pressure space 6.

A shank 28 provided with a threaded section 29 is formed onto the diaphragm 21 and a nut 17 is screwed onto said shank 28 the shank 28 is slideable in a bearing base provided by the disk 4 radially inward from the bores 14. A pressure spring 18 is incorporated between the disk 4 and the nut 17, by means of which pressure spring 18, the diaphragm 21 is thus always pressed back into its initial position in which said diaphragm 21 rests against the disk 4. Given a suction stroke, the agent to be conveyed is drawn into the work space 7 via a suction line 8 which is equipped with an intake valve 9 and, given a pressure stroke, said agent is conveyed into a pressure line 10 given a closed intake valve 9.

The diaphragm 21, as can be derived in detail from FIGS. 2 through 6, consists of a clamping area 22 which is clamped between the housing parts 2 and 3 or, respectively, the disks 4 and 5, of a work area 23 and of a bending zone 24 provided between said areas 22 and 23. Further, the end face 25 of the diaphragm 21 facing the work space 7 is designed as a planar surface and, in contrast thereto, a thickening 27 which merges into the diaphragm shank 28 is formed on the end face 26 facing the pressure space 6.

Radially directed incisions 30 in the form of grooves are worked into the planar end face 25 so that the agent to be conveyed can easily flow off. Further, a concentric recess 31 is provided for the acceptance of the intake valve 9. The other end face 26 of the diaphragm 21 is also provided with radially directed incisions 32 in order to discharge the drive working substance, namely, the incisions are worked into the end face of the thickening 27 trapezoidally shaped in cross-section and are also worked into its conical generated surface.

In the sample embodiment shown, the bending zone 24 exhibits a cross-sectional surface which steadily increases toward the thickening 27, whereby said surface rises on the end face 26 at an angle of inclination $\beta$. The size of the angle of inclination $\beta$ is determined from the section modulii at the transitions a and b of the bending zone 24 into the thickening 27 or, respectively, into the clamping area 22. And the section modulus at the transition b is calculated on the basis of the maximum load for an assumed angular section $\alpha$ by means of which the width $b_2$ for the outer diameter $d_2$ is determined and which is stressed for flexing. Since the section modulus for the transition a should be higher than the section modulus at the transition b by a factor of 1.1 through 5, thus this angle of inclination $\beta$ can be determined.

The ratio of the section modulii is analogously converted into the ratios of the thicknesses $h_1$ and $h_2$ at the transition a from the thickening 27 into the bending zone 24 and at the transition b from said bending zone 24 into the clamping area 22. This relationship is characterized by the equation $$\frac{d_1 \cdot \pi \cdot \alpha}{360 \cdot 6} \cdot h_1^2 = k \cdot \frac{d_2 \cdot \pi \cdot \alpha}{360 \cdot 6} \cdot h_2^2$$

whereby k represents a factory in the magnitude of 1.1 through 5. Moreover, we proceed from the fact that the value $h_2$ should amount to between 0.5 and 2 mm.

The maximum stroke s of the diaphragm 21 should amount to up to 5 mm. Since the diameter $d_2$ of the transition b derives from the desired conveying volume and since the admissible stroke is known, $d_1$ can be selected with sufficient precision in order to design the pump 1.

The angle of excursion $\gamma$ of the bending zone 25 can be determined according to the equation.

$$\tan\gamma = \frac{2 \cdot s}{d_2 - d_1 \text{ variable}}$$

Figure 7:
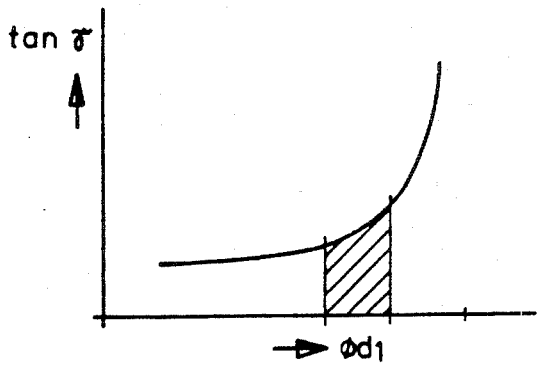
FIG. 7 shows a trigonometric functional drawing.

Thereby, the diameter $d_1$, as is illustrated in FIG. 7, should be selected in the transition range between the flat and the steep rise of a curve of the trigonometric function of the angle $\gamma$ and the varied diameter $d_1$.

We claim as our invention:

1. A one piece molded plastics material diaphragm for high pressure pumps, compressors and the like which comprises a membrane having an outer peripheral margin providing an annular clamping area, an annular bending zone adjacent thereto, and a thickened central work area, said thickened central work area projecting from a rear face of the membrane, said bending zone increasing in thickness from the clamping area toward the work area, radially narrow transition zones between the work area and the bending zone and between the bending zone and clamping area, the thickness of the bending zone increasing from the transition zone between the bending zone and the clamping area to the transition zone between the bending zone and work area, and wherein the thickness of the bending zone adjacent the transition to the clamping area and adjacent the transition to the work area are determined according to the equation:

$$\frac{d_1 \cdot \pi \cdot \alpha}{360 \cdot 6} \cdot h_1^2 = k \cdot \frac{d_2 \cdot \pi \cdot \alpha}{360 \cdot 6} \cdot h_2^2$$

wherein k represents a factor from 1.1 through 5, $h_1$ and $h_2$ are thicknesses adjacent the clamping and working area respectively, $d_1$ and $d_2$ are the inner and outer diameters of the bending zone respectively and $\alpha$ represents any assumed angular section extending from the center of the diaphragm through the transition zones.

2. A one piece molded plastics material diaphragm for separating the work and drive chamber of pumps, compressors and the like which comprises a disk having a free state displaying a thickened outer peripheral margin providing a radially extending clamping area, and a thickened rigid central work area and an annular bending zone joining the inner peripheral portion of the thickened clamping area with the outer peripheral portion of the thickened central work area, said disk in a free state having a substantially planar first face for confronting said working chamber and an opposite second face for confronting said drive chamber with the thickened central work area projecting into the drive chamber from said second face, and said bending zone being thinner than said clamping and working areas and having an inclined linear surface on the second face diverging from the planar first face increasing the thickness of the bending zone from the inner peripheral portion of the clamping area, and radially narrow transition zones merging the bending zone with the clamping and work areas, the disk having a first thickness at a first transition zone from the work area to the bending zone which is thicker than a disk second thickness at a second transition zone from the bending zone to the clamping zone substantially according to the formula $d_1 \cdot h_1^2 = k \cdot d_2 \sim h_2^2$ where $d_1$ is the diameter of the disk at the first transition zone and $h_1$ is the first thickness, $d_2$ is the diameter of the disk at the second transition zone and $h_2$ is the second thickness, and k is from 1.1 through 5 whereby all of the flexing of the diaphragm is confined to the bending zone between the thicker clamping and work areas.

3. The diaphragm of claim 2 wherein radial grooves are provided in the planar first face thereof.

4. The diaphragm of claim 2 wherein the planar first face has a recess in its central portion.

5. The diaphragm of claim 2 wherein the thickened central work area has a trapezoidal cross section.

6. The diaphragm of claim 2 wherein the thickened central work area has radially directed grooves.

7. The diaphragm of claim 2 wherein $h_2$ is between 0.5 through 2 mm.

* * * * *